US009388645B2

(12) United States Patent
King

(10) Patent No.: US 9,388,645 B2
(45) Date of Patent: Jul. 12, 2016

(54) APPARATUS AND METHOD FOR REDUCING VIBRATION IN A BOREHOLE

(75) Inventor: James G. King, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 895 days.

(21) Appl. No.: 13/330,184

(22) Filed: Dec. 19, 2011

(65) Prior Publication Data

US 2013/0153243 A1 Jun. 20, 2013

(51) Int. Cl.

| | |
|---|---|
| ***E21B 33/12*** | (2006.01) |
| ***E21B 43/00*** | (2006.01) |
| ***E21B 17/10*** | (2006.01) |
| ***E21B 47/01*** | (2012.01) |

(52) U.S. Cl.
CPC ..... *E21B 17/1035* (2013.01); *E21B 47/011* (2013.01)

(58) Field of Classification Search
CPC . E21B 33/1208; E21B 33/12; E21B 17/1035; E21B 17/026; E21B 47/01
USPC ..... 166/118, 179, 369, 133, 191
See application file for complete search history.

(56) References Cited

U.S. PATENT DOCUMENTS

| | | | | |
|---|---|---|---|---|
| 4,042,023 | A | 8/1977 | Fox | |
| 4,601,334 | A | 7/1986 | Lovegrove | |
| 7,630,605 | B2 | 12/2009 | Bringuier et al. | |
| 7,687,571 | B2 | 3/2010 | Vaidya et al. | |
| 7,784,537 | B2 | 8/2010 | Baxter | |
| 7,836,960 | B2 * | 11/2010 | Patel et al. | 166/385 |
| 8,322,415 | B2 * | 12/2012 | Loretz et al. | 166/250.17 |
| 2004/0211571 | A1 | 10/2004 | Moreira et al. | |
| 2009/0250228 | A1 * | 10/2009 | Loretz et al. | 166/387 |
| 2010/0212891 | A1 * | 8/2010 | Stewart et al. | 166/250.12 |
| 2010/0230094 | A1 * | 9/2010 | Foster et al. | 166/179 |
| 2010/0236779 | A1 | 9/2010 | Nutley et al. | |
| 2010/0263858 | A1 * | 10/2010 | Chauffe | 166/179 |
| 2011/0061862 | A1 * | 3/2011 | Loretz et al. | 166/250.11 |
| 2011/0155368 | A1 * | 6/2011 | El-Khazindar | 166/250.01 |
| 2011/0214920 | A1 * | 9/2011 | Vail, III | E21B 33/10 175/57 |
| 2011/0253393 | A1 * | 10/2011 | Vaidya et al. | 166/387 |
| 2011/0315377 | A1 * | 12/2011 | Rioufol | 166/250.17 |
| 2012/0168160 | A1 * | 7/2012 | Nutley et al. | 166/287 |
| 2013/0153243 | A1 * | 6/2013 | King | 166/369 |

FOREIGN PATENT DOCUMENTS

SU 1239268 A * 6/1986

* cited by examiner

*Primary Examiner* — Daniel P Stephenson
(74) *Attorney, Agent, or Firm* — Cantor Colburn LLP

(57) ABSTRACT

In one aspect, an apparatus for use in a borehole includes a tubular disposed in the borehole. The apparatus also includes an expandable device disposed outside the tubular and proximate a selected device, the expandable device including a material that causes the expandable device to expand from a first shape to a second shape when exposed to an activating fluid. In addition, the expandable device reduces vibration of the selected device when the expandable device is in the second shape.

21 Claims, 5 Drawing Sheets

APPARATUS AND METHOD FOR REDUCING VIBRATION IN A BOREHOLE

BACKGROUND OF THE DISCLOSURE

1. Field of the Disclosure

The disclosure relates generally to apparatus and methods for hydrocarbon fluid production from boreholes.

2. Description of the Related Art

To form a wellbore or borehole in a formation, a drilling assembly (also referred to as the "bottom hole assembly" or the "BHA") carrying a drill bit at its bottom end is conveyed downhole. The wellbore may be used to store fluids in the formation or produce fluids from the formation, such as hydrocarbons, from one or more production zones in the formation. Several techniques may be employed to stimulate hydrocarbon production. For example, a plurality of wellbores, such as a first and second wellbore, may be formed in a formation wherein the first wellbore is used as an injection wellbore and the second wellbore is used as a production wellbore. A flow of pressurized fluids from the first wellbore into the formation causes the formation fluids to flow to the production wellbore. To inject a fluid into the formation, fluid under pressure is supplied from a surface source, such as pumps, into a tubular disposed in the first or injection wellbore. One or more flow control devices, such as valves, are located in the tubular to control the flow of the pressurized fluid from the injection well into the formation. The pressurized fluid injected into the formation causes an increased pressure within the formation resulting in flow of the formation fluid into a producing string located in the second wellbore.

One type of flow control device is controlled from the surface. A control signal used to control the device may pass through a line or tubing external to the tubing that receives the pressurized fluid. In addition, other instrumentation may also be deployed downhole. During an injection operation, the instrumentation and external tubing are subjected to vibration. In addition, other downhole operations, including but not limited to production, fracturing and acidizing operations, can also cause downhole vibration that may shorten the life of downhole instruments and components.

SUMMARY

In one aspect, an apparatus for use in a borehole includes a tubular disposed in the borehole. The apparatus also includes an expandable device disposed outside the tubular and proximate a selected device, the expandable device including a material that causes the expandable device to expand from a first shape to a second shape when exposed to an activating fluid. In addition, the expandable device reduces vibration of the selected device when the expandable device is in the second shape.

In another aspect, a method for producing fluid from a borehole includes providing an expandable device configured to expand from a first shape to a second shape when exposed to an activating fluid and positioning the expandable device in the first shape on a tubular at a selected location in the borehole. The method also includes directing the activating fluid to the selected location to cause the expandable device to expand from the first shape to the second shape to reduce vibration experienced by equipment proximate the expandable device.

BRIEF DESCRIPTION OF THE DRAWINGS

The disclosure herein is best understood with reference to the accompanying figures in which like numerals have generally been assigned to like elements and in which.

DETAILED DESCRIPTION

Figure 1:
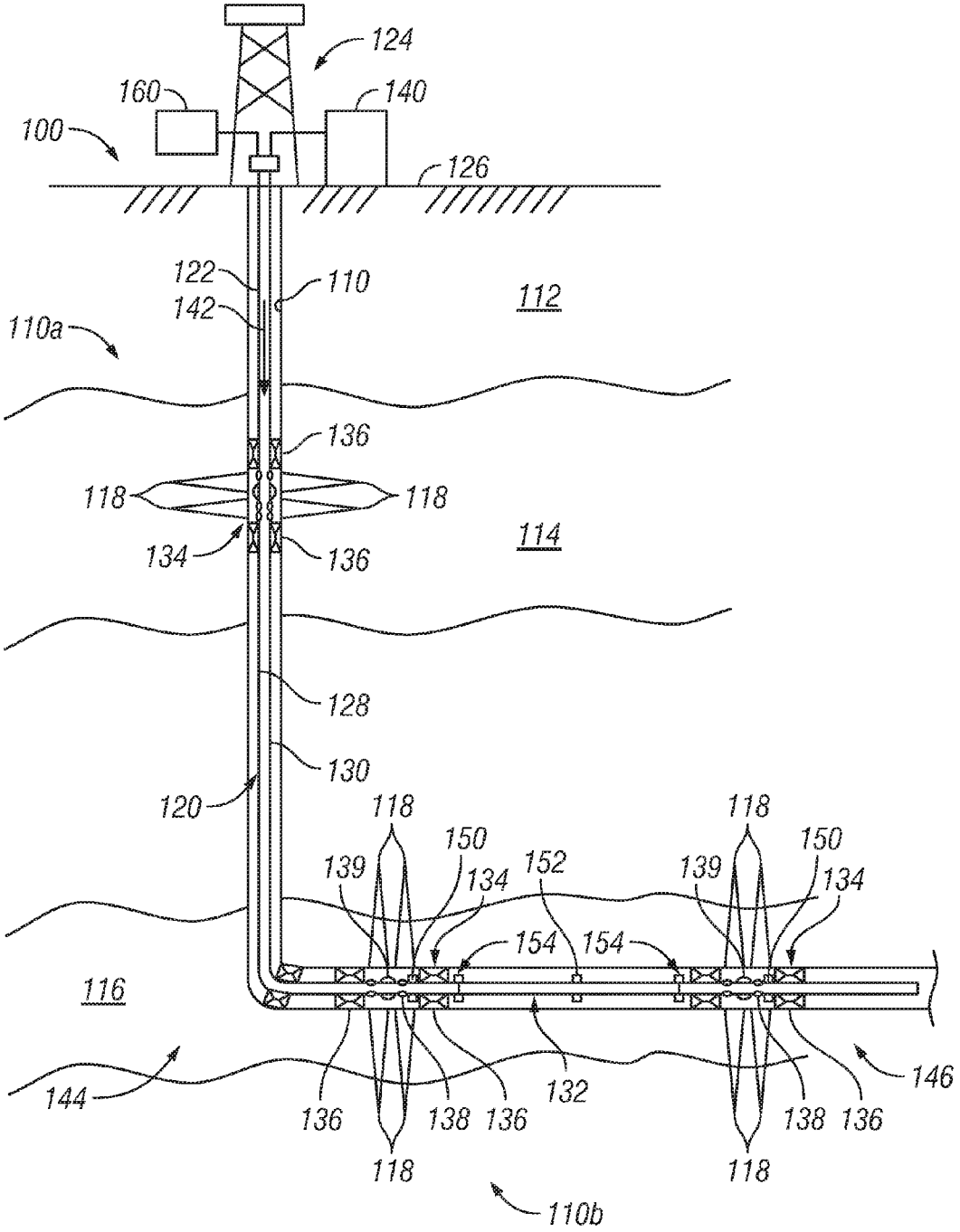
FIG. 1 is a schematic view of an embodiment of a system that includes a production tubular and injection apparatus.

FIG. 1 shows an exemplary wellbore system 100 that includes a wellbore 110 drilled through an earth formation 112 and into production zones or reservoirs 114 and 116. The wellbore 110 is shown lined with an optional casing having a number of perforations 118 that penetrate and extend into the formation production zones 114 and 116 so that fluids may flow from the wellbore 110 into the production zones 114 and 116 to cause fluid production from the zones. The exemplary wellbore 110 is shown to include a vertical section 110*a* and a substantially horizontal section 110*b*. The wellbore 110 includes a string (or production tubular) 120 that includes a tubular (also referred to as the "tubular string" or "base pipe") 122 that extends downwardly from a wellhead 124 at surface 126 of the wellbore 110. The string 120 defines an internal axial bore 128 along its length. An annulus 130 is defined between the string 120 and the wellbore 110, which may be an open or cased wellbore depending on the application.

The string 120 is shown to include a generally horizontal portion 132 that extends along the deviated leg or section 110*b* of the wellbore 110. Flow assemblies 134 are positioned at selected locations along the string 120. Each flow assembly 134 may be isolated within the wellbore 110 by packer devices 136. Although only two flow assemblies 134 are shown along the horizontal portion 132, a large number of such flow assemblies 134 may be arranged along the horizontal portion 132. In addition, another flow assembly 134 is disposed in vertical section 110*a* to affect production from production zone 114.

As depicted, each flow assembly 134 (also referred to as "flow apparatus") includes equipment configured to control fluid communication between a formation and a tubular, such as string 120. The exemplary flow assemblies 134 include one or more flow control apparatus or valves 138 to control flow of one or more injection fluids from the string 120 into the production zones 114, 116. A fluid source 140 is located at the surface 126, wherein the fluid source 140 provides fluid via string 120 to the injection assemblies 134. In one embodiment, each flow assembly 134 may provide fluid to one or more formation zone (114, 116) to induce formation fluid to flow to a second production string (not shown). In another embodiment, fluid may flow from the tubular 120 to stimulate the formation 114 and 116, causing vibration. In yet another embodiment, fluid flows from the formation 114 and 116, leading to vibration in the tubing 120. In another embodiment, fluid flows from another wellbore (not shown) into the tubing 120, causing vibrations in the tubing. Injection fluids may include any suitable fluid used to cause a flow of formation fluid from formation zones (114, 116) to a production wellbore and string, such as the wellbore 110. Injection fluids may include a fluid used to reduce or eliminate an impediment to fluid production. As used herein, the term "fluid" or "fluids" includes liquids, gases, hydrocarbons, multi-phase fluids, mixtures of two of more fluids, water and fluids injected from the surface, such as water and/or acid. Additionally, references to water should be construed to also include water-based fluids; e.g., brine, sea water or salt water. It should be understood, that the depicted arrangement may apply to any suitable application for controlling vibration or movement, including injection and/or production (in-flow) applications.

In an embodiment, injection fluid, shown by arrow 142, flows from the surface 126 within string 120 (also referred to as "tubular" or "injection tubular") to flow assemblies 134. Flow control devices 139 (also referred to as "injection apparatus" or "valves") are positioned throughout the string 120 to distribute the fluid based on formation conditions and desired production. The flow control devices 139 may be controlled by a controller, such as surface controller 160, wherein control lines or tubing runs from the controller 160 to the devices. The flow assemblies 134 may each also include a gauge 138 and expandable device 150. The gauges 138 (or "sensor assemblies") may include one or more devices to monitor various parameters proximate the flow control devices 139, such as pressure, temperature and flow rate. The expandable devices 150 are devices configured to reduce vibration and shock for nearby components, such as the gauge 138 and control lines. The expandable devices 150 may be deployed in the wellbore 110 in a first shape and run-in to a selected location. Once in the selected location, a selected fluid is circulated downhole across the expandable devices 150, wherein the selected fluid causes the devices to expand. The expandable devices may be positioned anywhere downhole to reduce vibration and provide shock absorption for downhole devices. For example, an expandable device 152 is positioned substantially in the middle of a segment 153 and generally centered between joints 154 and packers 136, wherein the joints 154 are where tubular segments or sections are joined together by clamping devices. The expandable device 152 reduces vibration that occurs along the tubular sections between the joints 154. When expanded, the expandable devices 150 and 152 reduce vibration and shock experienced by downhole components, thereby reducing downtime and maintenance.

Figure 2:
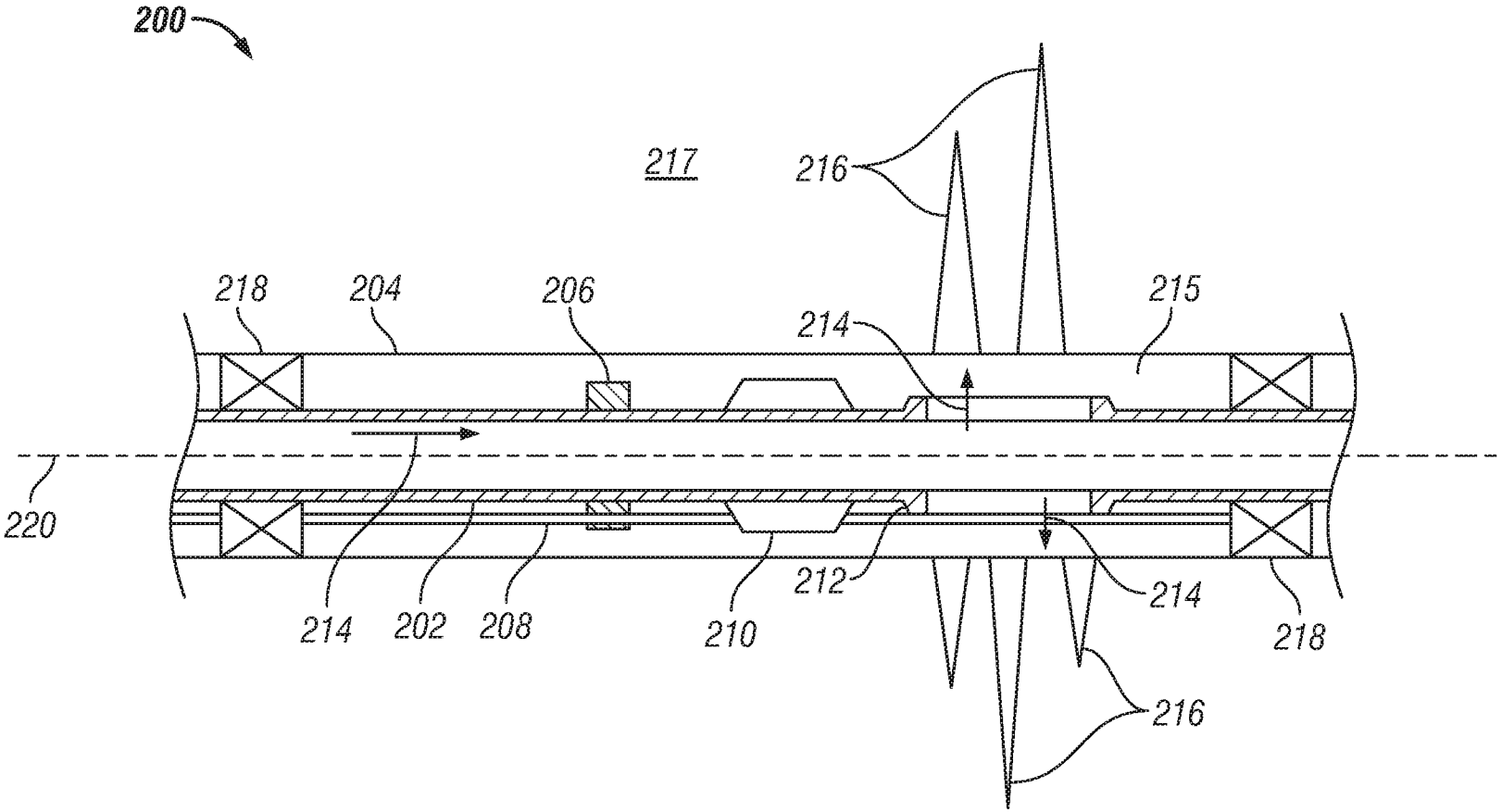
FIGS. 2 and 3 are sectional side views of a portion of an exemplary apparatus for use in a borehole.
Figure 3:
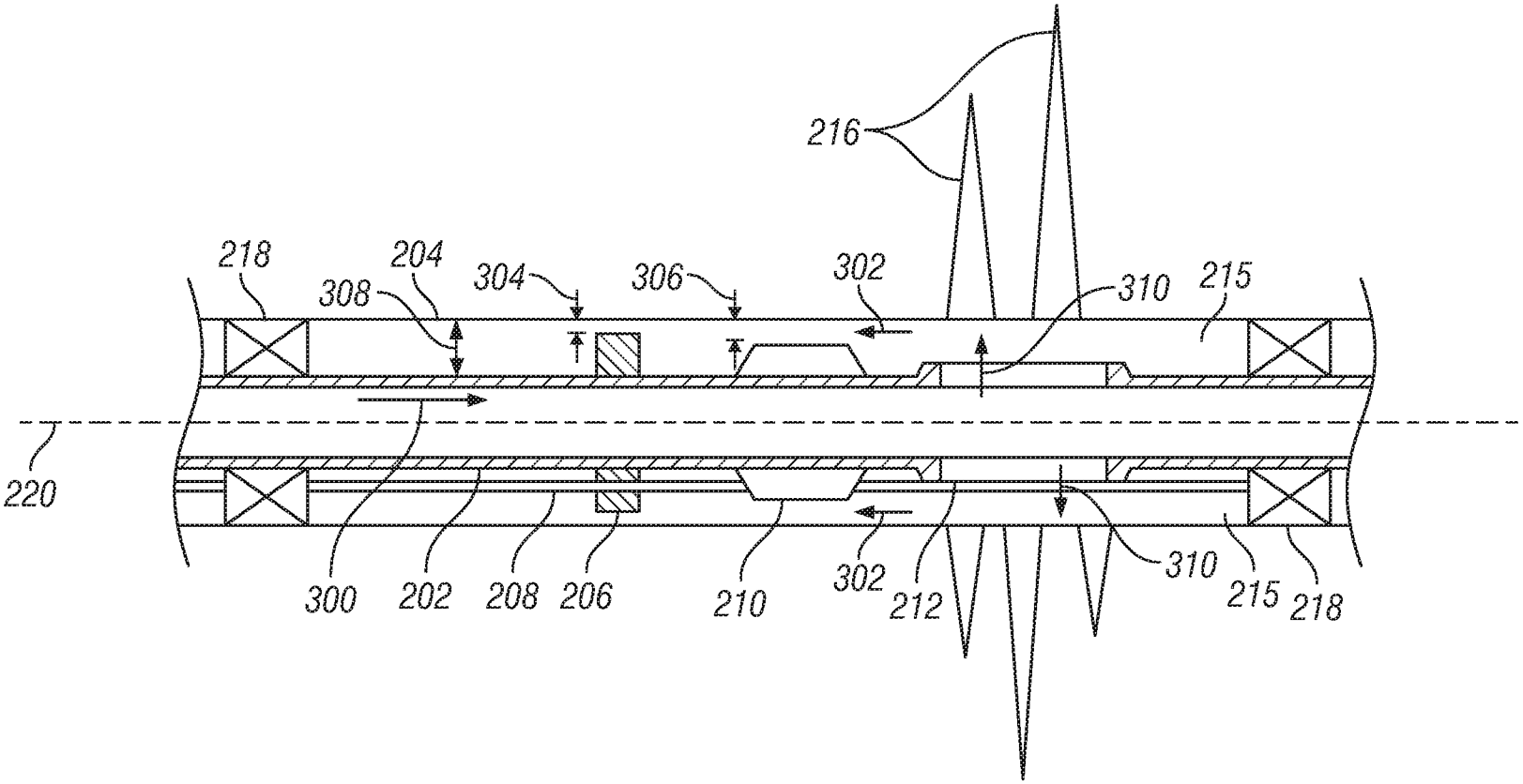

FIGS. 2 and 3 are sectional side views of a portion of an exemplary apparatus 200 for use in a borehole. The apparatus 200 includes a tubular 202 disposed along an axis 220 within a borehole 204. An expandable device 206 is disposed about the tubular 202, wherein the device is shown in a first shape ("first state" or "original shape"). A tubing or control line 208 (or "tubing") and sensor module 210 (or "gauge") are also disposed outside the tubular 202. A flow control device, such as a sliding sleeve 212, is located on tubular 202 and is configured to allow fluid 214 to flow from within the tubular 202 into an annulus 215 between the tubular 202 and the borehole 204. In an embodiment, the fluid 214 is configured to flow into or out of perforations 216 in a formation 217. In other embodiments, the fluid 214 flows into or out from the formation 217 directly. In yet another embodiment, the fluid 214 flows into or out from natural or induced fractures which are similar to perforations 216. As depicted, packers 218 isolate a section of the borehole 204, thereby enabling control over fluid flow, fluid pressure and other parameters between the packers 218, while also preventing unwanted contaminants from entering the fluid.

As depicted in FIG. 2, the expandable device 206 is in the first shape, which is compacted to allow the device to be run into the borehole 204. The exemplary expandable device 206 comprises a ring or circular geometry, wherein the device is disposed on at least a portion of an outer surface of the tubular 202. The expandable device 206 is made from a suitable material configured to cause expansion of the device when exposed to a selected treatment, such as an activating fluid. One example of the material is an elastomeric polymer. In an embodiment, the fluid 214 includes an activating fluid to cause expansion of the expandable device 206. The activating fluid may be any suitable fluid, including, but not limited to, water, oil, diesel fuel or mineral oil. After exposure to the activating fluid, the material swells, causing the expandable device 206 to expand or swell in a radial and/or axial direction within the borehole 204, as shown in FIG. 3. In an embodiment where the activation fluid is water or a water solution, the expandable device 206 is made from a material that includes water-absorbing particles incorporated into a nitrile-based polymer. After the expandable device 206 is exposed to water, the water-absorbing particles absorb and swell to expand the device. In one example the water-absorbing particles are hydroscopic particles. Further, the swelling behavior of the device when exposed to water may be described as an osmotic property. In another embodiment where the activation fluid includes hydrocarbons, such as oil, the expandable device 206 is made from a material that includes oleophillic polymers that absorb hydrocarbons into the matrix to swell and lubricate the device as it expands.

Figure 4:
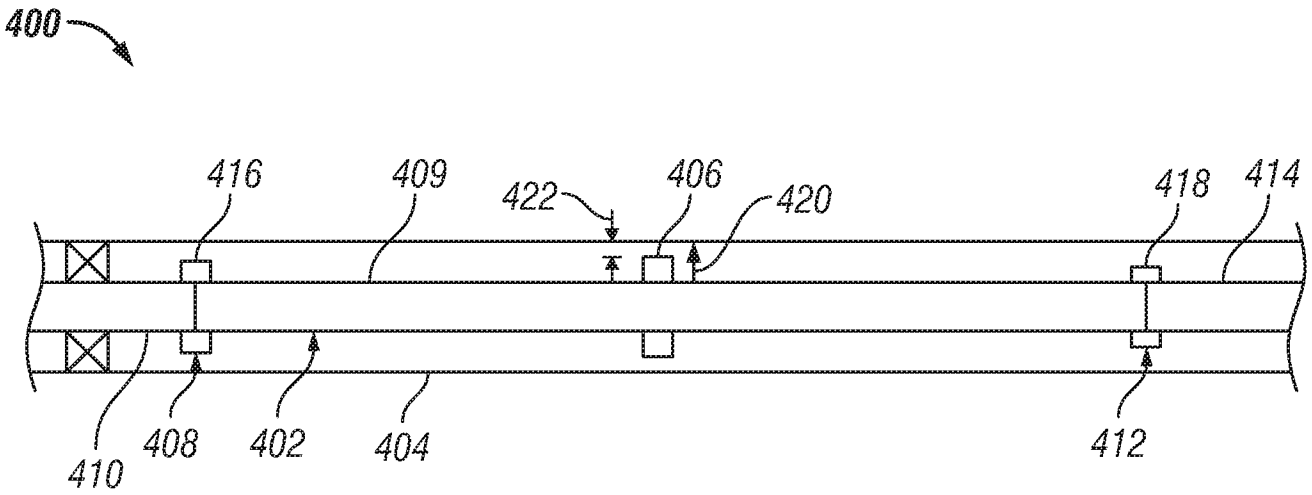
FIG. 4 is a side view of an exemplary section of downhole equipment.

After the equipment, including the expandable device 206, sensor module 210 and control line 208, are in the selected position within borehole 204, the fluid 214, including the activating fluid, flows along the tubular 202 downhole, wherein the fluid flows from a shoe or end of the tubular and into the annulus 215. The expandable device 206 expands as it is exposed to the activating fluid, thereby causing the device to expand. Any suitable method or system may be used to expose the expandable device 206 the activating fluid after the device is in a selected location downhole. In some embodiments, the expandable device 206 is positioned proximate other downhole equipment, such as the sensor module 210 and control line 208, to protect the equipment when the device is expanded. In addition, as shown in FIG. 1 and FIG. 4 below, the expandable device 152 is positioned proximate a middle of the tubular segment 153. In the examples, the expandable devices 152 and 206 are expanded to reduce the effects of vibration on equipment, wherein the vibration is caused by fluid flow through the tubular. In an embodiment, the expandable devices 152 and 206 provide dampening of vibration and shock in the tubular to protect the equipment proximate the devices. The equipment protected by the expandable device 152 and 206 includes, but is not limited to, tubular segment 153, string 120, sensor module 210 and control line 208.

FIG. 3 depicts the expandable device 206 in the expanded or second shape (or "expanded state") after a selected treatment, such as exposure to an activating fluid 300 and 302. In an embodiment, after the tubular 202, control line 208, sensor module 210 and sliding sleeve 212 are positioned at a selected location downhole, the activating fluid 300, 302 flow from the surface. Further, the activating fluid 300 flows within the tubular 202 through an end portion of the tubular, such as a shoe, and along the outside of the tubular 202 in the annulus 215. In embodiments, the fluid 302 flows past packers 218 before they are expanded in a sealing position. The activating fluid 300, 302 causes the expandable device 206 to expand radially and/or axially, thereby reducing a radial distance 304 from the device to the borehole 204. In the expanded or second shape, the expandable device 206 has the radial distance 304 that is less than a radial distance 306 from the sensor module 210 to the borehole 204. Further, the radial distance 304 is less than a radial distance 308 from the control line 208 to the borehole 204. Thus, the expanded shape of the expandable device 206 reduces vibration, shock and stress experienced by the control line 208 and sensor module 210. For example, the expanded shape of the expandable device 206 reduces or dampens vibration caused by a fluid flow 310 from the sliding sleeve 212. In certain embodiments, the expandable device 206 in the expanded shape may be substantially in contact with the borehole, where the contact is not sealing. In the example, the radial distance 304 is approximately non-existent (or zero). In other embodiments, the expandable device 206 in the expanded shape may be in contact with the borehole or not in contact with the borehole.

FIG. 4 is a side view of a section of exemplary downhole components or equipment 400. The downhole equipment 400 includes a tubular 402 positioned in a borehole 404. An expandable device 406 is positioned proximate a middle portion of a segment 409 of the tubular 402, wherein the segment 409 abuts adjacent segments 410 and 414 at joints 408 and 412, respectively. In an embodiment, clamps or supports 416 and 418 are positioned on joints 408 and 412 to provide support and reduce stress. Thus, by placing and expanding the expandable device 406 proximate the middle or center of segment 409, the device reduces or dampens vibration and shock experienced by the tubular segment 409. Specifically, a reduced radial distance 422 from the device to the borehole 404 reduces tubular movement 420 in a radial direction.

Figure 5:
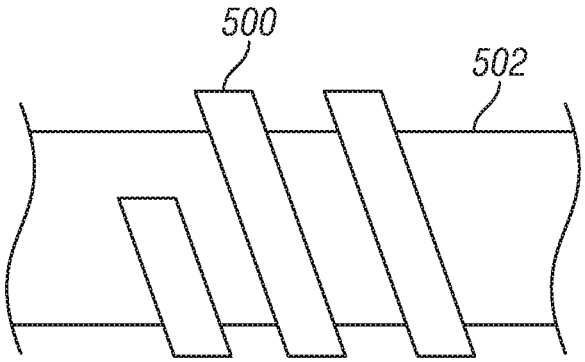
FIG. 5 is a detailed side view of an exemplary expandable device placed on a tubular.
Figure 6:
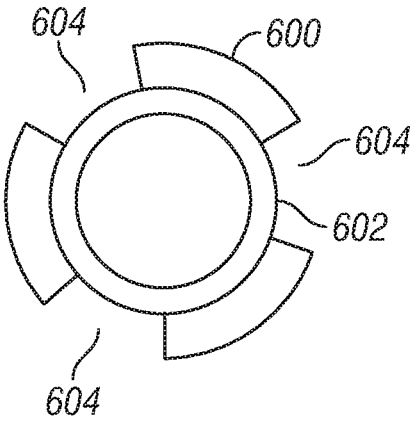
FIG. 6 is a detailed end view of an exemplary expandable device placed on a tubular.

The expandable device may be any suitable shape or configuration, depending on manufacturing and/or application requirements. The expandable device may be applied or positioned on the tubular by any suitable technique, such as the following non-limiting examples, adhesives, spraying, wrapping and/or baking. The expandable devices 206 and 406, shown in FIGS. 2-4, are substantially ring shaped member. An expandable device 500, shown in FIG. 5, is a helical member disposed about the tubular 502. FIG. 6 is an end sectional view of a sectional ring shaped expandable member 600 disposed on a tubular 602. In an embodiment, the expandable member 600 is applied as a single member by a suitable technique, such as adhesives, wrapping and/or spraying. The single member is the cut or machined to provide axial passages 604 in the expandable device 600, thereby enabling increased axial fluid flow across the device.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. An apparatus for use in a borehole, the apparatus comprising:

a tubular disposed in the borehole; and an expandable device disposed outside the tubular and proximate a selected device, the expandable device comprising a material that causes the expandable device to expand from a first shape to a second shape when exposed to an activating fluid and the expandable device provides at least one axial passage for an axial fluid flow of a wellbore fluid, wherein the expandable device reduces vibration of the selected device when the expandable device is in the second shape and the expandable device in the second shape is located in the borehole in a manner not sealing against a wall of the wellbore.

2. The apparatus of claim 1, wherein the selected device is a control line coupled to the tubular and wherein the expandable device is disposed about the control line to reduce the vibration experienced by the control line when the expandable device is in the second shape.

3. The apparatus of claim 2, wherein a radial distance of the second shape of the expandable device to the wall of the borehole is less than a radial distance from the control line to the wall of the borehole.

4. The apparatus of claim 1, wherein the selected device is a sensor module coupled to the tubular proximate a flow control device, and wherein the expandable device reduces the vibration experienced by the sensor module when the expandable device is in the second shape.

5. The apparatus of claim 4, wherein the second shape of the expandable device has a radial distance to the wall of the borehole less than a radial distance from the sensor module to the wall of the borehole.

6. The apparatus of claim 1, wherein the expandable device comprises a ring disposed about the tubular.

7. The apparatus of claim 1, wherein the expandable device comprises a helical member disposed about the tubular.

8. The apparatus of claim 1, wherein the expandable device in the second shape is located in the borehole in a manner that is one of: (i) in contact with the wall of the borehole; and (ii) not in contact with the wall of the borehole.

9. The apparatus of claim 1, wherein the expandable device comprises water-absorbing particles and the activating fluid comprises water.

10. The apparatus of claim 1, wherein the expandable device comprises oleophillic polymers and the activating fluid comprises hydrocarbons.

11. A method for producing fluid from a borehole, the method comprising:

providing an expandable device providing at least one axial passage for an axial fluid flow of a wellbore fluid configured to expand from a first shape to a second shape when exposed to an activating fluid;

positioning the expandable device in the first shape on a tubular at a selected location in the borehole; and directing the activating fluid to the selected location to cause the expandable device to expand from the first shape to the second shape to reduce vibration experienced by equipment proximate the expandable device wherein the expandable device in the second shape is located in the borehole in a manner not sealing against a wall of the wellbore.

12. The method of claim 11, wherein positioning the expandable device comprises positioning the expandable device about a control line coupled to the tubular to reduce vibration experienced by the control line when the expandable device is in the second shape.

13. The method of claim 12, wherein the second shape of the expandable device has a radial distance to the wall of the borehole less than a radial distance from the control line to the wall of the borehole.

14. The method of claim 11, wherein positioning the expandable device comprises positioning the expandable device proximate a sensor module to reduce vibration experienced by the sensor module when the expandable device is in the second shape.

15. The method of claim 14, wherein the second shape of the expandable device has a radial distance to the wall of the borehole that is less than a radial distance from the sensor module to the wall of the borehole.

16. The method of claim 11, wherein positioning the expandable device on the tubular comprises disposing one of a ring or a helical member about the tubular.

17. The method of claim 11, wherein directing the activating fluid downhole comprises causing the expandable device to expand to the second shape to locate the expandable device in the borehole as one of: (i) in contact with the wall of the borehole; and (ii) not in contact with the wall of the borehole.

18. An apparatus for use in a borehole, the apparatus comprising:

a tubular disposed in the borehole; and an expandable device disposed outside the tubular, the expandable device comprising a material that causes the expandable device to expand from a first shape to a second shape when exposed to an activating fluid and the expandable device provides at least one axial passage for an axial fluid flow of a wellbore fluid, wherein the expandable device in the second shape reduces vibration experienced by equipment proximate the expandable device and is located in the borehole in a manner not sealing against a wall of the wellbore.

19. The apparatus of claim 18, wherein the expandable device is positioned proximate a middle of a tubular segment with a packer proximate each end of the tubular segment, wherein the expandable device in the second shape reduces vibration experienced by the tubular segment.

20. The apparatus of claim 18, comprising a control line and sensor module coupled to the tubular, wherein the expandable device in the second shape reduces vibration experienced by the control line and sensor module.

21. The apparatus of claim 20, wherein the second shape of the expandable device has a radial distance to the wall of the borehole that is less than a radial distance from the control line or the sensor module to the wall of the borehole.

* * * * *